US006948273B2

(12) United States Patent
Baker

(10) Patent No.: US 6,948,273 B2
(45) Date of Patent: Sep. 27, 2005

(54) SAFETY MECHANISM FOR GUN

(75) Inventor: Richard Baker, Tampa, FL (US)

(73) Assignee: Henry Repeating Arms Company, Brooklyn, NY (US)

( * ) Notice: Subject to any disclaimer, the term of this patent is extended or adjusted under 35 U.S.C. 154(b) by 0 days.

(21) Appl. No.: 10/772,400

(22) Filed: Feb. 6, 2004

(65) Prior Publication Data

US 2005/0183313 A1 Aug. 25, 2005

(51) Int. Cl.[7] ..... F41A 17/82
(52) U.S. Cl. ..... 42/70.08; 42/66; 42/70.06
(58) Field of Search ..... 42/66, 70.01, 70.08, 42/70.04; 89/27.12

(56) References Cited

U.S. PATENT DOCUMENTS 644,660 A * 3/1900 Caldwell ..... 42/70.08
3,701,213 A * 10/1972 Lewis ..... 42/65
3,988,848 A * 11/1976 Chatigny ..... 42/70.08
4,218,839 A * 8/1980 Brouthers ..... 42/65
4,316,341 A * 2/1982 Landry ..... 42/70.08
4,807,380 A * 2/1989 Domian ..... 42/65
4,962,606 A 10/1990 Pozzi
5,664,356 A 9/1997 Pantuso et al.
5,673,506 A * 10/1997 Pantuso et al. ..... 42/67
6,442,880 B1 9/2002 Allan
6,460,282 B1 * 10/2002 Bustos ..... 42/66

* cited by examiner

*Primary Examiner*—Michael J. Carone
*Assistant Examiner*—Gabriel S. Sukman
(74) *Attorney, Agent, or Firm*—Shoemaker and Mattare

(57) ABSTRACT

The hammer of a gun has a channel in its front face, making direct contact between the hammer and the gun's firing pin impossible. The tip of a transfer bar retained within the channel moves to fill the channel and thus permit firing of the gun, only when the trigger is pulled. This construction avoids certain types of accidental discharge.

6 Claims, 5 Drawing Sheets

SAFETY MECHANISM FOR GUN

BACKGROUND OF THE INVENTION

This invention relates to guns, particularly rifles having firing pins.

Every gun has a mechanism which fires an ammunition round when the trigger is pulled. Most guns have at least one safety to prevent inadvertent discharge of the round. Typically, a spring-loaded hammer is released when the trigger is pulled; the hammer falls either directly against a round, or against a firing pin which in turn strikes the round. Firing pin safeties are sometimes used in the latter type of gun. Trigger safeties are very common in all types. Neither type of safety, however, prevents certain types of inadvertent firing, for example when a loaded gun is dropped. Then the hammer may strike the round or the firing pin, without the trigger having been moved.

SUMMARY OF THE INVENTION

An object of the invention is to prevent certain types of inadvertent gun discharge.

Another object is to provide a safety mechanism which does not interfere with sliding contact between the gun's bolt and hammer.

These and other objects are attained by a mechanism which includes a hammer having a channel in its forward face, the channel providing clearance around the rear of the firing pin so that the hammer cannot directly strike the firing pin. A transfer bar is mounted in the channel, and the tip of this element moves to a position filling the channel behind the firing pin, so as to impact the firing pin, only when the trigger has been pulled. Thus inadvertent firing, when the trigger has not been pulled, is prevented.

BRIEF DESCRIPTION OF THE DRAWINGS

The accompanying drawings depict, by way of example, a lever action rifle. It should be understood, however, that the invention is not limited to this type of gun, and in fact may be applied to any gun having a hammer, a trigger and a firing pin.

DESCRIPTION OF THE PREFERRED EMBODIMENT

Figure 1:
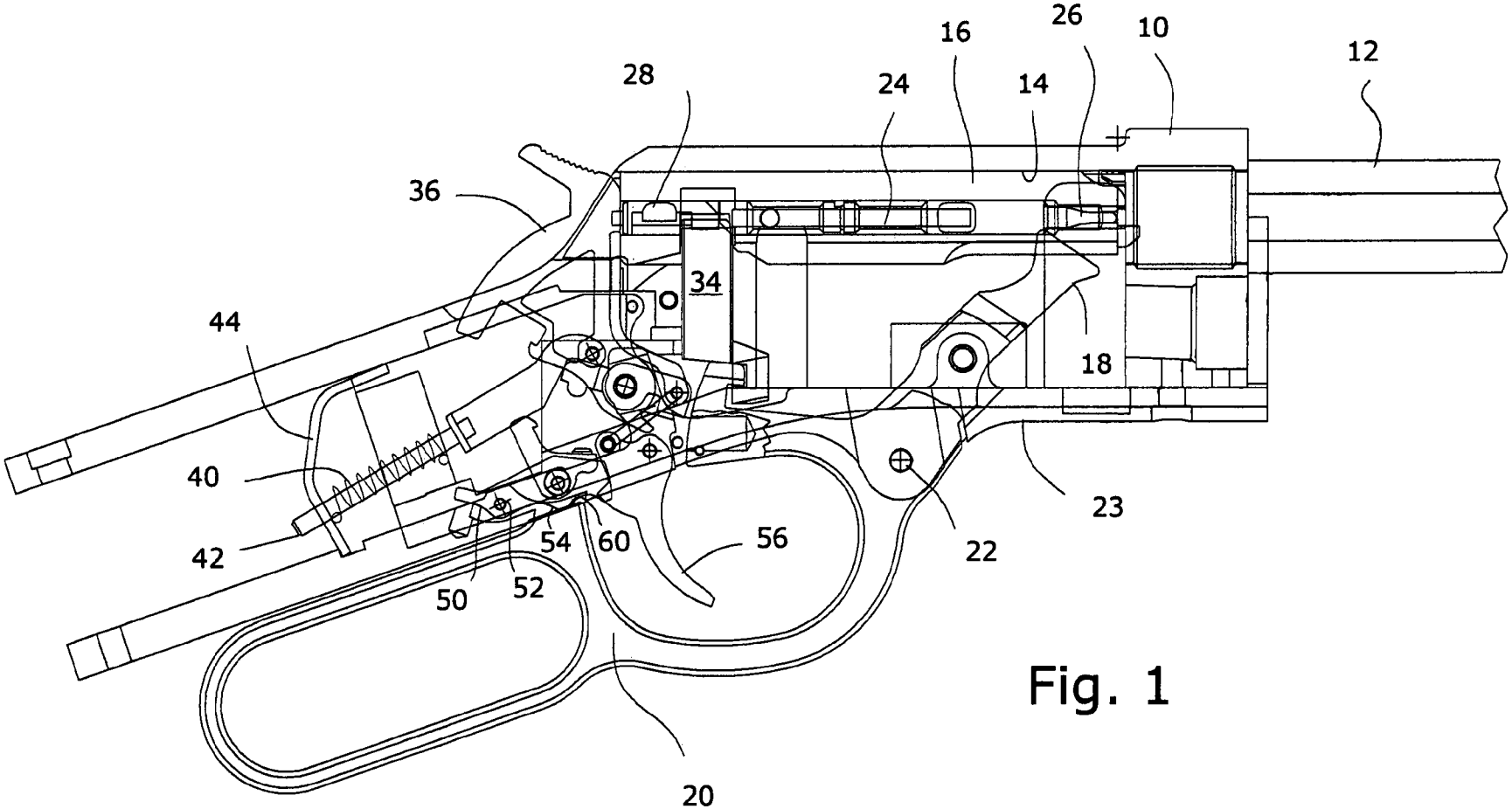
FIG. 1 is a sectional side elevation of a portion of a lever action rifle embodying the invention.

The lever action rifle shown in FIG. 1 is largely conventional, in that it includes a stationary receiver 10 to which a stock (not shown) is attached at the rear, and a barrel 12 is attached at the front. The receiver has a cavity 14 in which a bolt 16 can slide fore and aft. The bolt is moved by the forward end 18 of the finger lever 20 which pivots on a transverse pin 22 extending through holes at the bottom of a trigger guide plate 23. The guide plate is attached, front and rear, to the bottom of the receiver by screws (not shown).

The rifle illustrated has a two-piece firing pin assembly, lying on an axis aligned with that of the barrel. The front firing pin part 24 has a nose 26 which impacts the detonator of an ammunition round when it is driven forward by the rear part 28 of the firing pin. The rear part has a front surface with a bevel 30 (FIG. 2) at the top; the front part has a rear surface with a complementary bevel 32 at the bottom. When the parts are axially aligned, as shown in FIG. 1, the rear part can drive the front part forward; however, when the gun is being cocked, the rear part can pivot downward, and in this configuration the firing pin is discontinuous and will not operate to fire the round. This provides safety in case the gun is dropped, or the hammer is manually released, when the gun is not cocked. A locking bar 34 moves upward when the lever is in the closed position shown in FIG. 1; the bar pushes the rear part 28 of the firing pin upward into alignment with the front part 24, enabling firing.

While the described example has a two-piece firing pin, it should be understood this invention is also applicable to guns having a one-piece firing pin.

Figure 2:
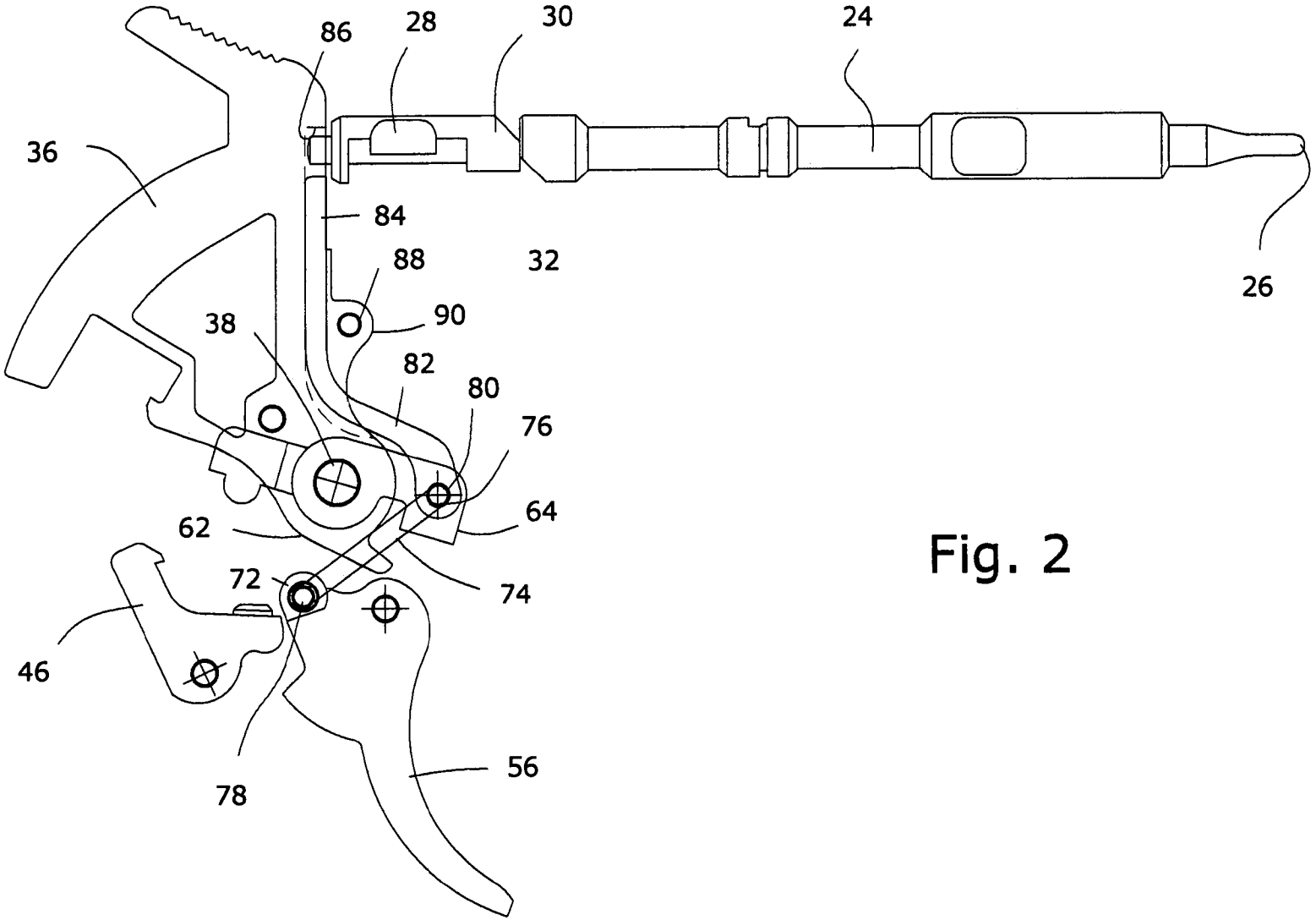
FIGS. 2–6 are the same view of the gun, at an enlarged scale, with many parts removed for clarity, showing a normal firing sequence.

The hammer 36 of the gun is mounted on a pivot pin 38 (FIG. 2). The hammer is urged forward by a spring 40 (FIG. 1) mounted around a guide rod 42, which passes through a hole in a guide 44 attached to the receiver. The hammer can be drawn rearward with the thumb, or pushed back by the bolt 16 when the lever 20 is operated, to a cocked position.

Figure 4:
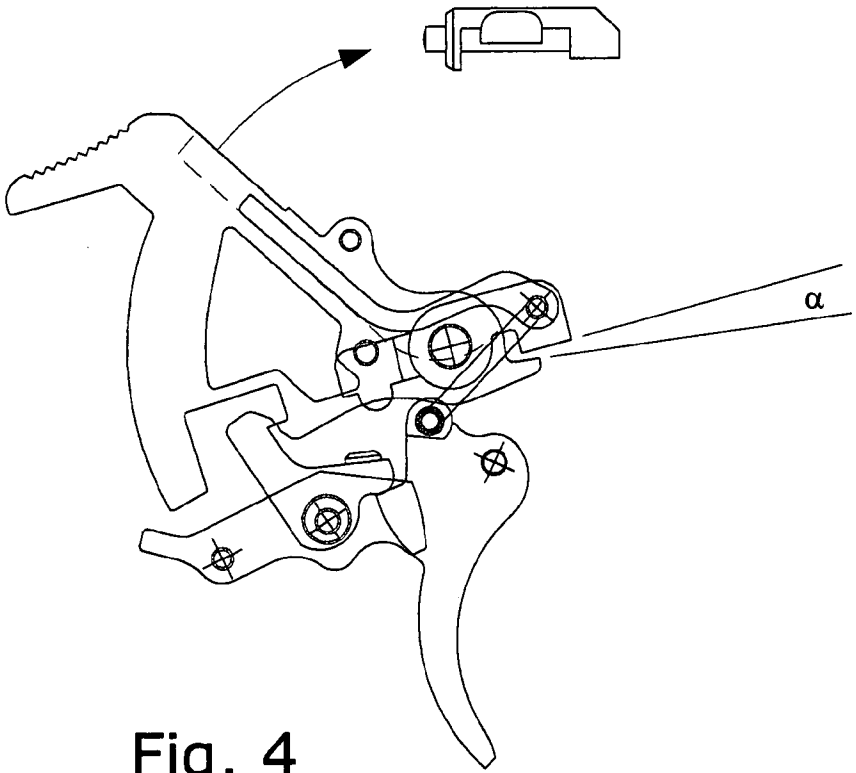
Figure 3:
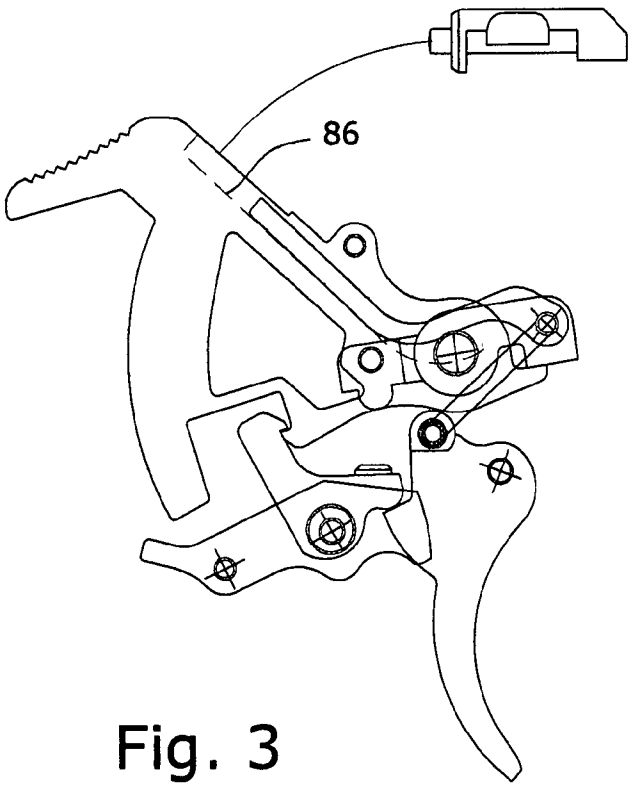

A sear is a latch which holds the hammer in its cocked position. In this example, the sear 46 is biased forward to its latched position (FIG. 3) by a spring, and it is moved rearward to its unlatched position (FIG. 4) when the trigger is pulled rearward.

A trigger lock prevents the trigger from being pulled until the trigger lock is released. The trigger lock in this example is a lever 50 mounted on a pin 52 supported in the trigger guard plate. It has a front portion 54 which can protrude downward through a slot in the guard plate to a position behind the trigger 56. This blocks trigger movement. The trigger lock is urged toward its locking position by a small coil spring (not shown) pressing upward on it at the rear. This bias is overcome by contact with an upper surface 60 on the finger lever when the finger lever is moved to its ready-to-fire position. The lever is latched in this ready position by a flexible pin (not shown) which engages below a protuberance on the finger lever.

To this point, the illustrated gun is conventional. The new features of this invention are described below.

Figure 8:
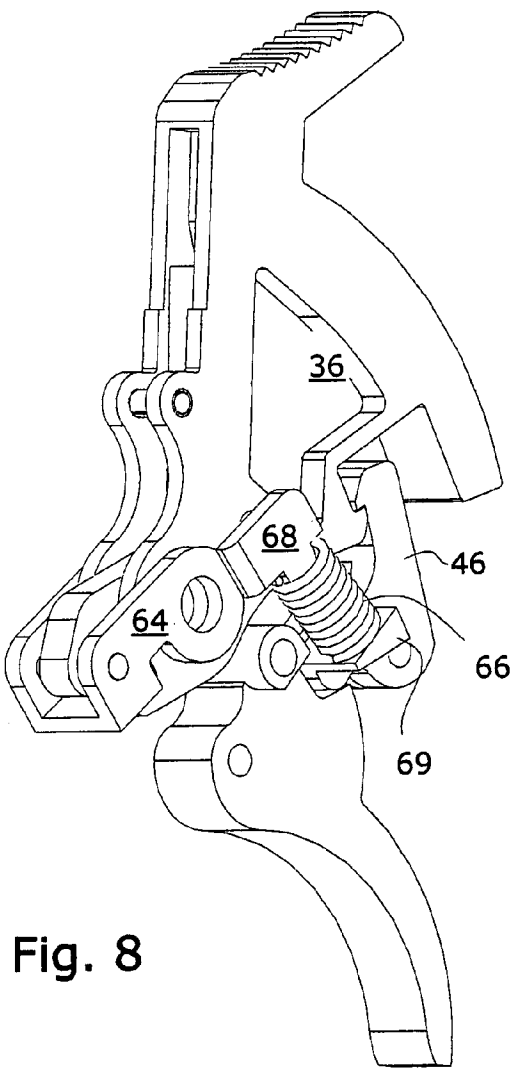
FIG. 8 is another isometric, with the hammer removed to show underlying detail.
Figure 7:
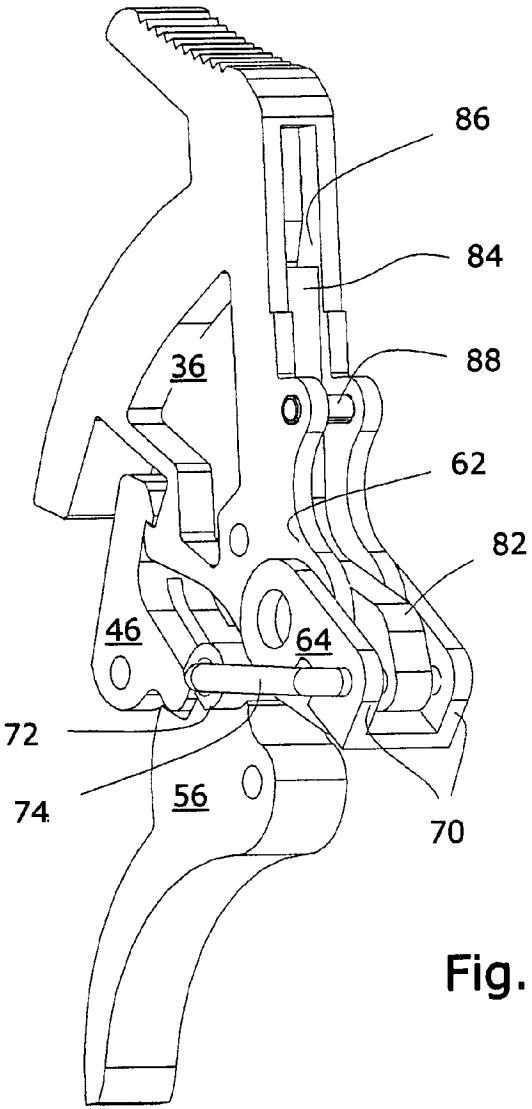
FIG. 7 is an isometric view of selected parts of the gun.

As shown in FIGS. 2 and 7, the bottom end 62 of the hammer 36 sits in a cradle or rocker 64 which is mounted on the same pivot pin 38 as the hammer and thus has the same pivot axis. There is a lost-motion connection between the hammer and the rocker: when the hammer is drawn rearward, it engages the rocker during only about the rear half of its travel, pivoting the rocker in the same direction. But when the hammer is forward, the rocker can be pivoted rearward with respect to the hammer by holding the trigger back. A compression spring 66 (FIG. 8) seated on a pad 69 extending laterally from the sear and bearing upward against the rear 68 of the rocker resists this rearward pivoting, ensuring that the rocker is always tilted forward to the extent possible as the hammer falls.

The front end of the rocker has aligned transverse holes in its parallel sides 70. An upwardly extending boss 72, also with a transverse hole in it, is provided on the top surface of the trigger. A U-shaped rigid link 74 is installed with one transverse arm 76 in the rocker holes, and the other transverse arm 78 in the trigger boss hole, so that movement of the trigger and the rocker are related: they must pivot in opposite directions. Other linkages or mechanisms for producing this related movement may be possible.

The forward link arm 76 extends not only through the holes in the rocker, but also through a hole 80 at the bottom of a transfer bar 82 whose bottom portion is confined between the sides 70 of the rocker. The transfer bar is designed to avoid interfering with the sliding bolt movement. The bar has a straight upper tip portion 84 received in a channel 86 formed in the front surface of the hammer. A spring pin 88 passing through ears 90 in the hammer on either side of the channel retains the transfer bar in the channel. The channel is wider than the diameter of the rear end of the firing pin assembly, and is deep enough to clear it. The firing pin does not touch the sides, or the bottom, of the channel, even when the hammer is in its fully forward position. In fact, the hammer never directly contacts the firing pin; the two parts make contact only indirectly, through the transfer bar. Unless the tip of the transfer bar is in high in the channel, in a position behind the firing pin, the firing pin will not be struck, regardless of the motion or position of the hammer. This is true whether the hammer falls accidentally or is slowly let down with the thumb.

The tip 84 of the transfer bar is normally in a safe position in the channel, below the level of the firing pin. The position of the tip is determined by the angular position of the rocker relative to the hammer, and this relative position is controlled by the trigger; thus, the transfer bar is in a position to contact the firing pin only when the trigger is pulled.

Figure 6:
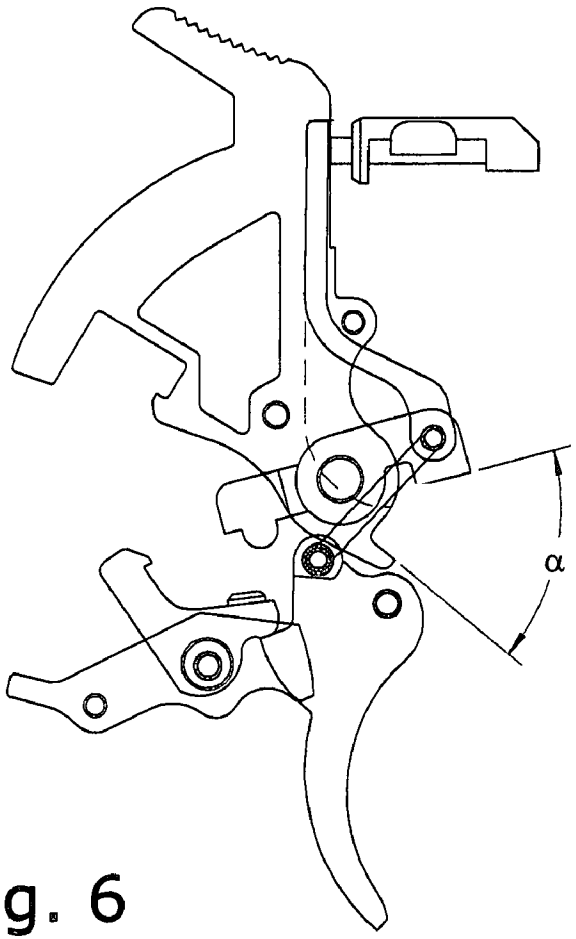
Figure 5:
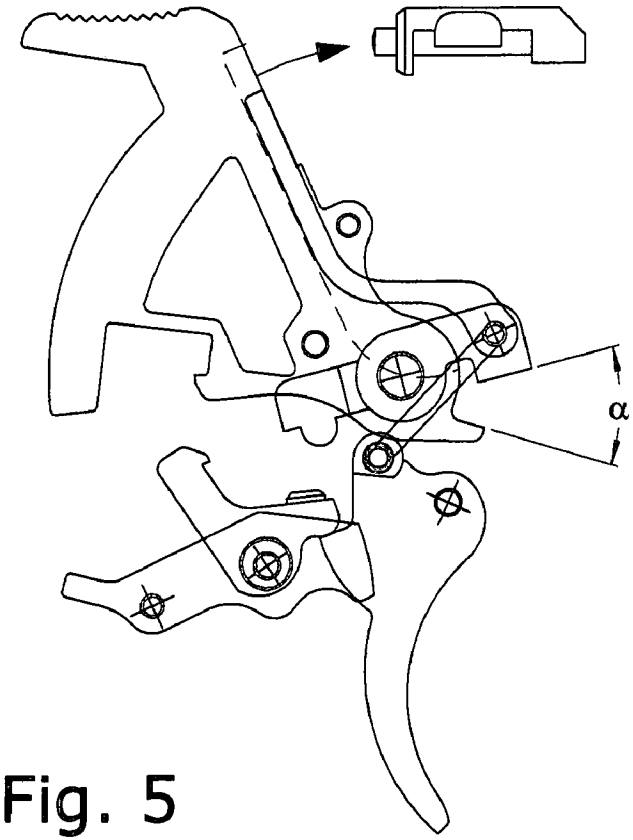

The movement of the transfer bar is depicted in the sequence of FIGS. 2–6. As mentioned above, the sear 46 is in its latched position in FIG. 3. It has been moved rearward to its unlatched position (FIG. 4) by pulling the trigger, which rotates the sear counter-clockwise. FIG. 5 shows the hammer starting to fall toward the firing pin. In FIGS. 2–6, the angle $\alpha$ between the rocker and the hammer is increasing. One can see from those figures that this relative rotation drives the transfer bar upward in its channel. The only time the tip of the bar is high enough in the channel to strike the firing pin is when the trigger is rearward and the hammer is forward (FIG. 6). FIG. 1 shows what happens when the hammer is released, without pulling the trigger. The tip portion 84 of the transfer bar 82 is below the level of the firing pin, and the hammer does not strike the pin.

The transfer bar need not be shaped exactly like the one shown in the drawings. It is possible, for example, to make the channel and the upper portion of the transfer bar curved, or to change the degree of offset between the upper portion and the lower portion. The principles of the invention may even be applied to guns not having firing pins. One might, for example, form a protuberance on the transfer bar tip intended to strike the ammunition detonator only when the bar was raised. Or one might modify the channel, for example by removing one of its sides, without substantially affecting its function. The claims below are intended to cover all such variations.

Since the invention is subject to modifications, it is intended that the foregoing description and the accompanying drawings shall be interpreted as only illustrative of the invention defined by the following claims.

I claim:

1. A gun comprising a body having a cavity for supporting a round of ammunition, a firing pin for striking the round of ammunition, a hammer for striking the firing pin, and a trigger mechanism for releasing the hammer, the hammer having a channel in its forward face for preventing direct contact between the hammer and the firing pin, a transfer bar situated in said channel, the transfer bar being movable between a safe position where it does not occupy a portion of the channel behind the firing pin, and a firing position where it does occupy the portion of the channel behind the firing pin, a rocker adapted for pivoting movement with respect to the hammer, a linkage extending between the trigger and the rocker for pivoting the rocker when the trigger is pulled rearward, and means connecting the rocker to the transfer bar such that the transfer bar can move to said firing position in the channel as the hammer falls forward only when the trigger is pulled rearward, wherein the rocker and the hammer are mounted for pivoting about a common axis with respect to the body.

2. The invention of claim 1, wherein said linkage has one end connected to the rocker at a point on a link axis a distance from said common axis and a second end connected to the trigger.

3. The invention of claim 2, wherein the linkage causes the rocker and trigger to pivot in opposite directions.

4. The invention of claim 1, wherein the rocker and the hammer have a lost motion connection whereby cocking of the hammer produces movement of the rocker only over part of the motion of the hammer.

5. The invention of claim 4, wherein the linkage is adapted to move the transfer bar upward within the channel toward said firing position when the rocker pivots rearward with respect to the hammer.

6. The invention of claim 1, wherein the gun has a sliding bolt and the transfer bar is adapted to avoid interfering with the bolt.

* * * * *